US005502904A

United States Patent [19]

Theurer et al.

[11] Patent Number: 5,502,904

[45] Date of Patent: Apr. 2, 1996

[54] MOBILE MACHINE FOR WITHDRAWING BALLAST FROM A BALLAST BED

[75] Inventors: Josef Theurer; Herbert Wörgötter, both of Vienna, Austria

[73] Assignee: Franz Plasser Bahnbaumaschinen-Industriegesellschaft m.b.H., Vienna, Austria

[21] Appl. No.: 297,136

[22] Filed: Aug. 29, 1994

[30] Foreign Application Priority Data

Aug. 31, 1993 [AT] Austria ..... 1749/93
Apr. 18, 1994 [AT] Austria ..... 805/94

[51] Int. Cl.[6] ..... E02F 5/22

[52] U.S. Cl. ..... 37/104; 171/16; 104/2

[58] Field of Search ..... 171/16; 37/104, 37/105, 106; 104/2, 7.1, 279; 15/340.1, 347; 134/21

[56] References Cited

U.S. PATENT DOCUMENTS 4,263,851 4/1981 Theurer et al. ..... 37/104 X
4,479,439 10/1984 Theurer et al. ..... 171/16 X
4,570,287 2/1986 Kerschner et al. ..... 15/346
4,576,538 3/1986 Theurer et al. ..... 104/2 X
4,611,541 9/1986 Theurer ..... 104/2
4,938,239 7/1990 Theurer et al. ..... 134/21
5,101,733 4/1992 Mohr ..... 104/2 X
5,400,718 3/1995 Theurer et al. ..... 104/2 X

FOREIGN PATENT DOCUMENTS 384446 4/1987 Austria .

*Primary Examiner*—Randolph A. Reese
*Assistant Examiner*—Victor Batson
*Attorney, Agent, or Firm*—Henry M. Feiereisen

[57] ABSTRACT

A mobile machine for withdrawing ballast from a ballast bed includes two receptacles, each of which including a separate intake port and discharge outlet, with a suction tube being selectively connectable to the intake ports of the receptacles. In order to selectively seal the intake ports in an air-tight manner, each intake port accommodates a closing element so as to allow an alternate emptying and filling of the receptacles without interruption of the withdrawal of ballast.

17 Claims, 3 Drawing Sheets

MOBILE MACHINE FOR WITHDRAWING BALLAST FROM A BALLAST BED

BACKGROUND OF THE INVENTION

The present invention refers to a mobile machine for withdrawing ballast from a ballast bed.

Mobile ballast bed machines are known which include a machine frame supported on undercarriages for movement along a track and a suction arrangement mounted on the machine frame. The suction arrangement is provided with a negative pressure generator and has a ballast receptacle with an intake port and a discharge outlet, with the intake port of the receptacle being operatively connected to a suction tube which is immersible in the ballast bed and has an inlet opening vertically adjustable and transversely displaceable by a drive unit.

A mobile ballast bed machine with suction arrangement of this type is known from e.g. U.S. Pat. No. 4,938,239. The suction arrangement has a total of three suction tubes which are spaced from each other transversely to the machine frame. Ballast withdrawn by the suction tubes is collected in a central ballast receptacle which—after being filled—is emptied. A drawback of such a mobile ballast bed machine is the decreased productivity because it does not permit a withdrawal of ballast while the receptacle is emptied.

Further suction arrangements are known from German Pat. No. DE 82 36 650 U, Swiss Pat. No. CH 451 987 B and U.S. Pat. No. 4,570 287.

SUMMARY OF THE INVENTION

It is an object of the present invention to provide an improved mobile machine for withdrawing ballast from a ballast bed, obviating the afore-stated drawbacks.

In particular, it is an object of the present invention to provide an improved mobile machine for withdrawing ballast from a ballast bed which operates at increased productivity.

These objects and others which will become apparent hereinafter are attained in accordance with the present invention by providing two receptacles which are each provided with a separate intake port and a discharge outlet, with at least one intake port of each receptacle being operatively connected to a closing member for allowing a selective air-tight sealing thereof.

In accordance with the present invention, it is now possible to continuously withdraw ballast and to alternate a charging of the receptacles with sucked-in ballast so that the productivity of the machine is significantly increased and the overall operation of the machine is enhanced. At the same time, a filled receptacle can be emptied without interruption and ballast can be immediately transported away e.g. to a loading car which is coupled to the machine. Suitably, the alternate charging of the receptacles is provided through selectively routing the suction flow and through appropriately actuating the closing members via a central control unit incorporating an OR circuit.

Preferably, each receptacle is connected to a filter unit via a further intake port which also accommodates a closing member controlled by the central control unit to regulate passage therethrough so that the flow of material from the receptacles to the filter units can be alternated accordingly.

In accordance with one embodiment of the present invention, the suction tube may be connected to the intake ports of both receptacles via a distributor which is defined by two passageways. The suction flow through the passageways is controlled by a deflector which is actuated by the central control unit for movement between two end positions so as to selectively route the suction flow through one or the other passageways of the distributor and to the respective receptacle.

In accordance with another embodiment of the present invention, the suction tube may also be directly attached to the receptacles via a slotted guide mechanism for allowing the suction tube to slide back and forth in a direction transversely to the machine frame for connection with either one of the intake ports of the receptacles. Suitably, the end of the suction tube in opposition to the intake ports is provided with a flange which is operatively connected to a drive unit for shifting between the intake ports of the receptacles.

Preferably, each receptacle accommodates a level indicator for generating a signal commensurate with a maximum filling level of ballast in the receptacle and for transmitting the signal to the control unit for suitable processing.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
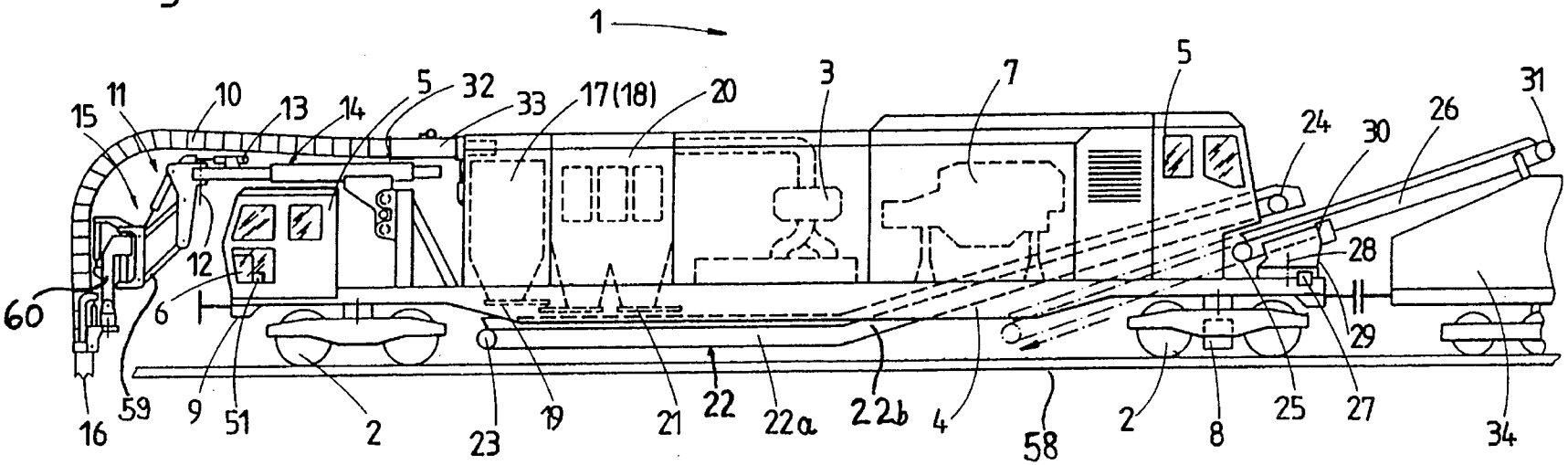
FIG. 1 is a side elevational view of one embodiment of a mobile ballast bed machine according to the present invention.

Throughout all the Figures, the same or corresponding elements are always indicated by the same reference numerals.

Turning now to the drawing, and in particular to FIG. 1, there is shown a side elevational view of one embodiment of a mobile machine according to the present invention for withdrawing ballast from a ballast bed, generally designated by reference numeral 1. The mobile machine 1 comprises a machine frame 4 which is supported on undercarriages 2 for movement on rails 58 in an operating direction. The mobile machine 1 is self-propelled and has a drive 8 connected to the wheels of one of the undercarriages 2. A motor 7, shown in broken line, is mounted on the machine frame 4 for supplying power to all the drives of the machine. At its opposing axial ends, the machine frame 4 carries an operator's cab 5, with one operators' cab (in FIG. 1 the left operator's cab) housing a central control unit 6 which includes an OR circuit 51.

A suction arrangement is mounted on the machine frame 4 and includes a negative pressure generator 3 disposed between the undercarriages 2, and a suction tube 10 which extends longitudinally beyond one end 9 of the machine frame 4 and terminates in an inlet opening 16 which projects into or is immersible in the ballast bed. The suction tube 10 is guided and supported by a support structure, generally designated by reference numeral 11 and including a cantilevered structure 14 which is mounted at one end to the machine frame 4 and is articulated at its other end to a mounting structure 15 for allowing an adjustment of the suction tube 10 and its inlet opening 16 about a vertical pivot axis 12. The mounting structure 15 includes a parallel linkage 59 which is connected to a mounting 60. A drive 13 acts upon the parallel linkage 59 to effect the adjustment of the suction tube 10.

The suction tube 10 is provided over a major portion thereof of flexible material, with its end 32 opposite to the inlet opening 16 being connected to a distributor 33. As will be described in more detail with reference to FIG. 2, the distributor 33 communicates with two ballast receptacles 17, 18 which are arranged side-by-side to oppose each other in a direction transversely to the machine frame 4. Each receptacle 17, 18 includes a discharge outlet 19 which is opened and closed by a suitable drive unit 50 (FIG. 3). Adjacent to the receptacles 17, 18 and arranged between the receptacles 17, 18 and the negative pressure generator 3 are two filter chambers 20 with closeable discharge outlets 21.

Extending underneath the discharge outlet 19 of both receptacles 17, 18 and the discharge outlets 21 of the filter chambers 20 as well as underneath the machine frame 4 is a conveyor belt section 22*a* of a conveyor belt which is generally designated by reference numeral 22 and includes a drive pulley 23 for providing drive torque. The conveyor belt section 22*a* is connected to an ascending conveyor belt section 22*b* which terminates in a discharge end 24 located above the undercarriage 2 at the (right) axial end of the machine frame 4 and underneath the (right) operator's cab 5. Situated underneath the discharge end 24 of the conveyor belt section 22*b* is the receiving end 25 of a transfer conveyor belt 26 which dumps withdrawn ballast to a loading car 34 that is suitably coupled to the machine frame 1. The transfer conveyor belt 26 is secured on a support 29 which is mounted to the machine frame 4 and rotates about a vertical pivot axis 28 by means of a rotating drive 27. Through rotation of the support 29 and thus of the transfer conveyor belt 26, ballast withdrawn from the ballast bed and cleaned by the suction flow can be returned to the track along the slope or to a storage car positioned on a neighboring track. As indicated by dashdot line, the transfer conveyor belt 26 is also movable longitudinally into an idle position by a further drive 30 for travel of the mobile machine 1 from site to site. A drive pulley 31 provides drive torque for selectively operating the transfer conveyor belt 26 in both directions of rotation. In this manner, cleaned ballast can be returned by the conveyor belt 26 to the track, in case of need.

Figure 2:
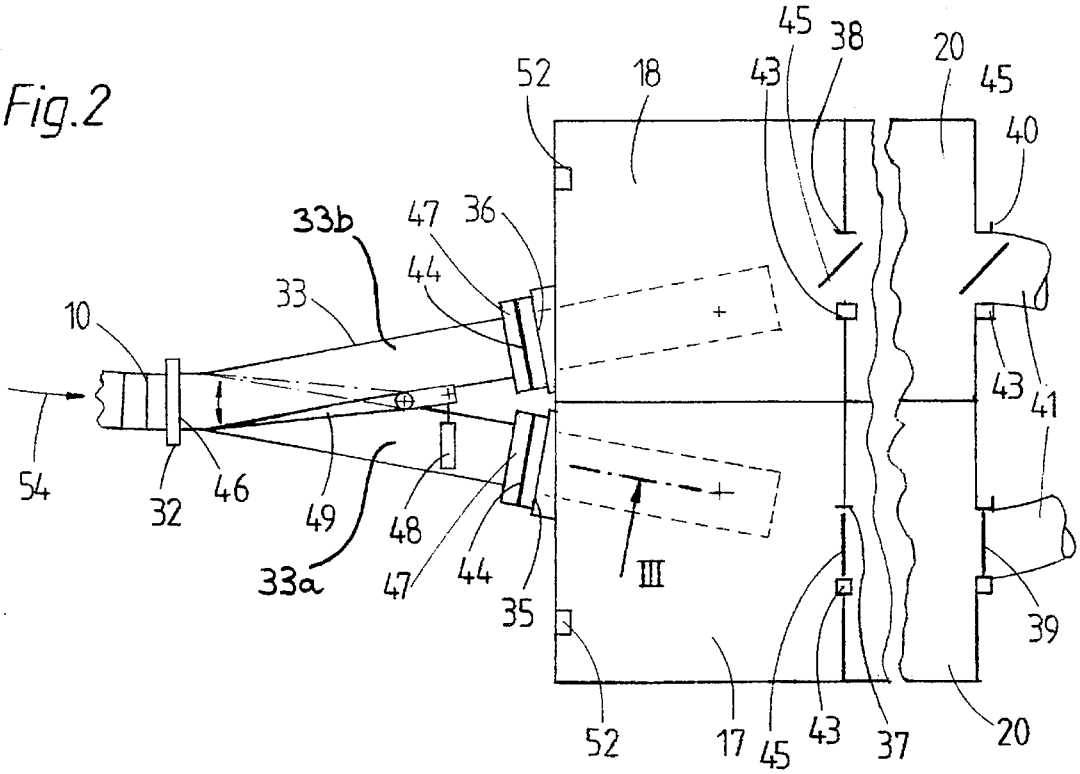
FIG. 2 is a fragmentary schematic top view of FIG. 1, showing in detail both receptacles of the suction arrangement and their connection to the suction tube.
Figure 3:
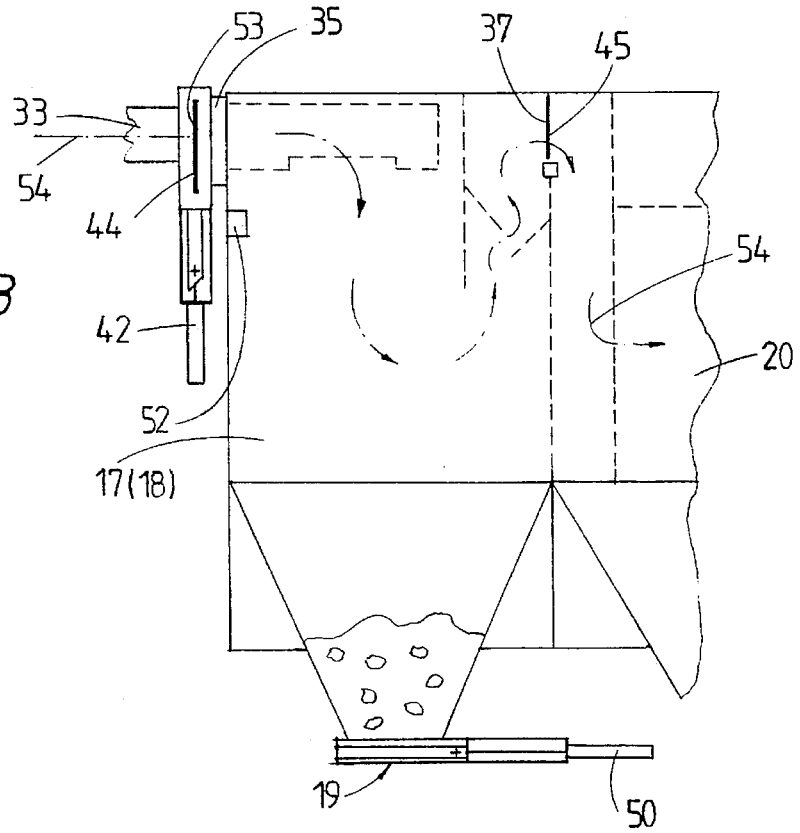
FIG. 3 is a fragmentary sectional view along line III of FIG. 2, showing one receptacle of the suction arrangement.

Turning now to FIG. 2, there is shown a fragmentary top view of the mobile machine 1, illustrating in detail the connection of the end 32 of the suction tube 10 with the intake ports 35, 36 of the receptacles 17, 18 via the distributor 33. The distributor 33 includes a central inlet port 46 which is suitably connected to the opposing end 32 of the suction tube 10. Extending from the central inlet port 46 at an acute angle to each other are two conduits 33*a*, 33*b* of the distributor 33 for defining two passageways for selectively routing withdrawn ballast to the intake ports 35, 36 of the receptacles 17, 18. The conduit 33*a* has an outlet port 47 which is suitably attached to the intake port 35 of receptacle 17, and the conduit 33*b* has an outlet port 47 which is suitably attached to the intake port 36 of receptacle 18.

In the area of the inlet port 46, the distributor 33 includes a slidable guide or deflector 49 which is acted upon by a drive 48 to swing about a vertical axis and to selectively route the suction flow through one or the other one of the passageways defined by the conduits 33*a*, 33*b*.

As further shown in FIG. 2, the receptacle 17 communicates with the adjoining filter chamber 20 via a further intake port 37, and the receptacle 18 communicates with the adjoining filter chamber 20 via a further intake port 38. Both filter chambers 20 are additionally provided with further intake ports 39, 40 which are each connected with the negative pressure generator 3 via a suction conduit 41. Each of the intake ports 35, 36 of the receptacles 17, 18 is controlled by a closing member 44 which is actuated by a drive 42 (FIG. 3). The intake ports 37, 38 between the receptacles 17, 18 and the filter chambers 20 as well as the further intake ports 39, 40 of the filter chambers 20 are also controlled by respective closing members 45 which are actuated by respective drives 43. As best seen in FIG. 2, the closing members 45 of each receptacle 17, 18 and adjoining filter chamber 20 are actuated in unison, i.e. they are both either open or closed.

It will be understood by persons skilled in the art that all drives 42, 43, 48 and 50 for actuating the respective closing members 44, 45, for shifting the deflector 49 and for opening and closing the respective discharge outlets 19 are activated by the OR circuit 51 of the central control unit 6.

As further shown in FIG. 2, each receptacle 17, 18 includes a level indicator 52 in form of a touch sensor for monitoring a maximum filling level. When ballast in the respective receptacle 17, 18 reaches the maximum filling level, the level indicators 52 form a signal which is transmitted to the control unit 6 for activation of the 0R circuit 51.

As best seen in FIG. 3, the closing member 44 accommodated in the intake ports 35, 36 is designed as gate valve or slide valve 53 which is moved by the drive 42 in a direction perpendicular to the suction flow as indicated in dashdot line (only closing member 44 for intake port 35 is shown in FIG. 3). While closing members 44 are shifted rectilinear in vertical direction, the closing members 45 rotate in order to open or close the respective intake ports 37, 38, 39, 40.

At operation, the suction tube 10 is lowered by the drive unit 13 of the support structure 11 to position the inlet opening 16 in the ballast bed. A suction flow is produced at the inlet opening 16 by the negative pressure generator 3 to withdraw ballast from the ballast bed and to route it to one of the receptacles 17, 18 through suitable control of the closing members 44, 45 and the deflector 49. In the non-limiting example of FIG. 2, ballast withdrawn from the ballast bed by the suction tube 10 is routed in direction of arrow 54 through the conduit 33*b* of the distributor 33 into the receptacle 18 to fill the latter with ballast. The deflector 49 is thus positioned by drive 48 to the end position shown in continuous line while closing member 44 allows flow of ballast through intake port 36. At the same time, drive 50 is actuated to open discharge outlet 19 and to empty the receptacle 17 from ballast. Intake ports 35, 37 of receptacle 17 are sealed in air-tight manner by the respective closing members 44, 45 so that air is prevented from reaching the distributor 33 through the discharge outlet 19.

The receptacle 18 is charged with ballast until the pertaining level indicator 52 indicates that ballast has reached the maximum filling level. At this point, a message is transmitted to the control unit 6 and the OR circuit 51 is activated for automatically actuating the drives 42, 43, 48 and 50 for suitable positioning the closing members 44, 45 and deflector 49 as well as controlling the discharge outlets 19. Thus, the deflector 49 is shifted into the position indicated in broken line in FIG. 2 to route the suction flow through conduit 33*a* and into the receptacle 17 while the closing members 44, 45 of the receptacle 17 are positioned to allow flow through the intake ports 35 and 37 after the discharge outlet 19 of the receptacle 17 has been closed immediately beforehand. At the same time, the intake ports 36, 38 of the receptacle 18 are sealed in air-tight manner through respective closing members 44, 45. Thereafter, the discharge outlet 19 of receptacle 18 is opened to empty stored ballast onto conveyor belt 22.

The change of the suction flow to one or the other receptacle 17, 18 and thus the charging and emptying of the receptacles 17, 18 can be carried out continuously without interruption of the ballast withdrawal. After sucked-in ballast reaches the maximum filling level in the receptacle 17, the control unit 6 automatically switches over again to fill the receptacle 18 which has been emptied in the meantime.

Figure 4:
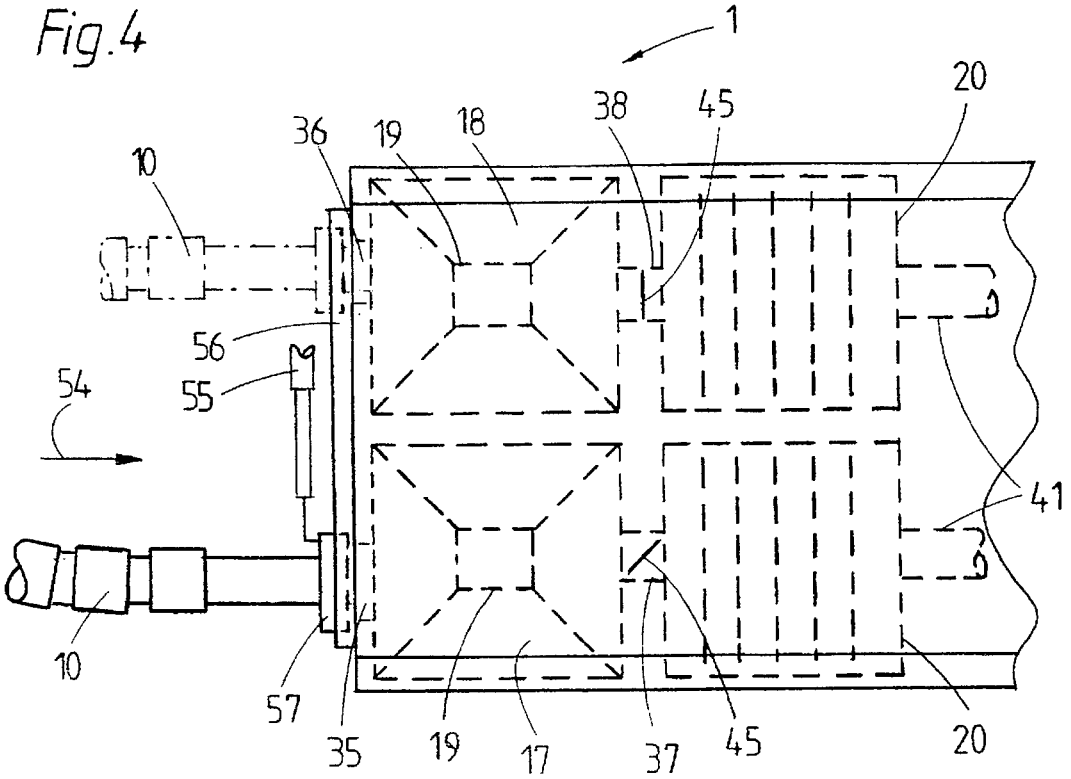
FIG. 4 is a fragmentary top view of another embodiment of a mobile ballast bed machine, showing a modified connection of the two receptacles of the suction arrangement with the suction tube.

Turning now to FIG. 4, there is shown a fragmentary top view of another embodiment of a mobile ballast bed machine, showing a modified connection of the two receptacles 17, 18 of the suction arrangement with the suction tube 10. The difference between this embodiment and the embodiment shown in FIGS. 1–3 resides in the omission of a distributor and the provision of a slidable support for the suction tube 10 by a drive 55 so as to shift the end 32 of the suction tube 10 between the intake port 35 of the receptacle 17 and the spaced-apart intake port 36 of the receptacle 18. Both intake ports 35, 36 are connected to each other via a slotted guide mechanism 56 in which a flange 57 attached to the end 32 of the suction tube 10 and to the drive 55 is guided for displacement in a direction transversely to the machine frame 1 and transversely to the suction flow.

In the non-limiting example of FIG. 4, the suction flow illustrated by arrow 54 is directed into the receptacle 17, with intake port 37 between the receptacle 17 and the adjoining filter chamber 20 being open. The intake port 38 between the receptacle 18 and the adjoining filter chamber 20 is sealed air-tight by the respective closing member 45. The discharge outlet 19 of the receptacle 18 is open for allowing emptying of ballast. As soon as the level indicator 52 (not shown in FIG. 4) registers a maximum filling of the receptacle 17, the central control unit 6 (not shown in FIG. 4) automatically closes the discharge outlet 19 of the receptacle 18 and actuates the drive 55 for moving the suction tube 10 to the intake port 36 of the receptacle 18. At the same time, intake port 37 of receptacle 17 is closed and the intake port 38 between the receptacle 18 and the filter chamber 20 is opened. Subsequently, the discharge outlet 19 of the receptacle 17 is opened for allowing a removal of ballast while further ballast is withdrawn from the ballast bed and directed to the receptacle 18. After the receptacle 18 is filled, the control unit 6 switches over again in a manner described above.

While the invention has been illustrated and described as embodied in a mobile machine for withdrawing ballast from a ballast bed, it is not intended to be limited to the details shown since various modifications and structural changes may be made without departing in any way from the spirit of the present invention.

What is claimed as new and desired to be protected by Letters Patent is set forth in the appended claims.

We claim:

1. A mobile machine for withdrawing ballast from a ballast bed of a track; comprising:

a machine frame extending in longitudinal direction along a track and supported on undercarriages for mobility on the track; and a suction arrangement mounted on said machine frame and comprising a suction tube having one end terminating in an inlet opening for immersion in ballast of the ballast bed, a negative pressure generator for producing a suction at said inlet opening of said suction tube, a pair of receptacles, each of which includes a discharge outlet and at least one intake port, with said intake ports of said receptacles being selectively connectable to said suction tube, and closing means operatively connected to at least one intake port of each of said receptacles for allowing a selective air-tight sealing of said intake ports of said receptacles.

2. The machine of claim 1, and further comprising a drive for vertically adjusting and transversely shifting said inlet opening of said suction tube.

3. The machine of claim 1 wherein said closing means includes a closing member placed within said intake port of each receptacle and a drive operatively connected to said closing member, said suction arrangement further comprising a control unit including an OR circuit which actuates said drive for moving said closing member between an opening position and a closing position.

4. The machine of claim 3, and further comprising a filter unit adjoining each receptacle and connected thereto via a further intake port, said closing means including a further closing member placed within said further intake port for selectively allowing an air-tight sealing of said intake port and a drive actuated by said OR circuit and operatively connected to said further closing member.

5. The machine of claim 1 wherein said suction arrangement includes a distributor means for selectively connecting said suction tube with said receptacles, said distributor means including a distributor having one end defining an inlet port which is connected to said suction tube and an opposing end defined by two outlet ports which respectively communicate with said intake ports of said receptacles.

6. The machine of claim 5 wherein said distributor means includes a deflector in the area of said inlet port of said distributor and a drive operatively connected to said deflector for selectively directing a suction flow to said outlet ports of said distributor.

7. The machine of claim 3 wherein said closing member is a gate valve movably supported in a direction perpendicular to a longitudinal axis of said suction tube.

8. The machine of claim 3 wherein said distributor means includes a deflector in the area of said inlet port of said distributor and a drive operatively connected to said deflector for selectively conducting a suction flow to said outlet ports of said distributor, said discharge outlet being provided with a drive for opening and closing said discharge outlet, said drive for said deflector and said drive for said discharge outlet being actuated by said OR circuit.

9. The machine of claim 1 wherein said suction tube has another end, said suction arrangement including a drive for selectively connecting said other end of said suction tube with said intake ports of said receptacles.

10. The machine of claim 9 wherein said suction arrangement includes a flange mounted to said other end of said suction tube and connected to said drive, and a slotted guide mechanism for slidably supporting said flange in a direction transverse to said machine frame.

11. The machine of claim 3, and further comprising a level indicator in each receptacle for generating a signal commensurate with a maximum filling level of ballast in said receptacle and for transmitting said signal to said control unit for activating said OR circuit.

12. A mobile ballast bed machine, comprising:

a machine frame supported on undercarriages for mobility on a track a suction means mounted on said machine frame for withdrawing ballast from a ballast bed;

a pair of receptacles arranged on said machine frame, each receptacle having an intake port;

a suction flow routing means for selectively connecting said intake ports of said receptacles with said suction means; and a flow regulating means operatively connected to said intake ports of said receptacles for allowing a selective air-tight sealing of said intake ports.

13. The machine of claim 12 wherein said suction flow routing means includes a distributor having one end defining an inlet port which is connected to said suction tube and an opposing end defined by two outlet ports which respectively communicate with said intake ports of said receptacles.

14. The machine of claim 13 wherein said distributor includes a deflector in the area of said inlet port and a drive operatively connected to said deflector for shifting said deflector between two end positions in which said inlet port is selectively connectable with said outlet ports.

15. The machine of claim 12 wherein said suction flow routing means includes a flange mounted to one end of said suction tube, and a slotted guide mechanism for slidably supporting said flange in a direction transverse to said machine frame for selectively connecting said one end of said suction tube with said intake ports of said receptacles.

16. The machine of claim 12 wherein said flow regulating means includes a closing member operatively connected to said intake port of each of said receptacles.

17. The machine of claim 12, and further comprising a control unit for operating said suction flow routing means and said flow regulating means, said control unit including an OR circuit.

* * * * *